US006227130B1

(12) United States Patent
Tsumiyama et al.

(10) Patent No.: US 6,227,130 B1
(45) Date of Patent: May 8, 2001

(54) SEAT LOCK DEVICE

(75) Inventors: Yoshinori Tsumiyama, Miki; Tomohiro Kanazawa, Amagasaki; Masafumi Ikeyama, Kobe, all of (JP)

(73) Assignee: Kawasaki Jukogyo Kabushiki Kaisha, Kobe (JP)

( * ) Notice: Subject to any disclaimer, the term of this patent is extended or adjusted under 35 U.S.C. 154(b) by 0 days.

(21) Appl. No.: 09/466,981

(22) Filed: Dec. 17, 1999

(30) Foreign Application Priority Data

Dec. 28, 1998 (JP) ..... 10-373914

(51) Int. Cl.[7] ..... B63B 17/00

(52) U.S. Cl. ..... 114/55.57; 114/363; 248/503.1; 296/65.03

(58) Field of Search ..... 114/363, 55.53, 114/55.55, 55.57; 296/65.03; 248/503.1

(56) References Cited

U.S. PATENT DOCUMENTS 4,667,917 * 5/1987 Takace ..... 248/398
5,048,450 * 9/1991 Oka ..... 114/363
5,649,684 * 7/1997 Denis et al. ..... 248/503.1

FOREIGN PATENT DOCUMENTS 57-94592 6/1982 (JP) .
60-81135 U 6/1985 (JP) .
61-59178 U 4/1986 (JP) .
62-125983 6/1987 (JP) .
63-76168 U 5/1988 (JP) .
2-162189 6/1990 (JP) .

* cited by examiner

*Primary Examiner*—Sherman Basinger
(74) *Attorney, Agent, or Firm*—Oliff & Berridge, PLC

(57) ABSTRACT

A seat lock device allows a seat to be unlocked and removed with one hand by rotating a lever member with one's fingertips and lifting an end portion of the seat. An engaging rod is mounted on either a bottom plate of a seat or a seat mounting bed. A support block, which has a locking rod, is mounted on the other of the seat bottom plate and the seat mounting bed. A lever member that engages with a bridge portion of the locking rod is pivotally mounted relative to the support block. Upon rotating the lever member with one's fingertips, both end portions of the locking rod are retracted against a biasing force of a spring from a receiving groove formed in the support block. Then, the engaging rod can be removed from the receiving groove to unlock the seat.

21 Claims, 6 Drawing Sheets

SEAT LOCK DEVICE

BACKGROUND OF THE INVENTION

1. Field of Invention

This invention relates to a seat lock device for vehicles, and preferably to a seat lock device applied to a straddle type seat, for example, of a personal water craft or a land vehicle.

2. Description of Related Art

In a vehicle equipped with a straddle type seat such as a personal water craft or a land vehicle, the seat is mounted on a seat mounting bed such that the seat can be removed or opened and closed. This type of a seat includes a seat bottom plate, a seat skin and a seat cushion mounted on the seat bottom plate. Generally, the seat is movably mounted on the seat mounting bed by a seat lock device that is disposed between the rear portion of the seat bottom plate and the seat mounting bed. Japanese Laid-Open Patent Publication No. 2-162189 (corresponding to U.S. Pat. No. 5,048,450), for example, discloses such a seat lock device.

The seat lock device disclosed in this Japanese publication includes, as shown in FIG. 7, an engaging member 102 made of a U-shaped bar member mounted under a seat 101 in a suspended manner and a hook 104 mounted on a seat mounting bed 103 and that couples to the engaging member 102. The hook 104 is integrally mounted on the distal end of an operating lever 105. The hook 104 and the operating lever 105 are held by a guide member 106 mounted on the seat mounting bed 103 such that they are movable alternately in a frontward and a rearward direction. Guide pins 107 which are protruded from the sides of the hook 104 move in guide holes 108 formed in the guide member 106 so as to guide the hook 104 only in the frontward and rearward directions. With a biasing force exerted by a return spring 109, the hook 104 is advanced or moved in the frontward direction and locking is performed by engaging the distal end of the hook 104 with the engaging member 102. To release the seat 101 from the locked state, the operating lever 105 is pulled manually in the rearward direction against the biasing force of the return spring 109, such that the distal end of the hook 104 is retracted. Hence, the hook 104 is released from the engaging member 102 and the seat 101 can be lifted.

With respect to the seat lock device having the construction described above, however, when an individual carries out the unlocking operation and the seat removing operation, the individual must perform two operations directed in two different directions. That is, at first, the operating lever 105 is pulled in the rearward direction against the biasing force of the return spring 109 using one hand. Then, the individual must lift the seat in an upward direction using another hand. In other words, both hands are necessary to perform the operations in two different directions.

SUMMARY OF THE INVENTION

It is an object of embodiments of this invention to provide a seat lock device with which one can readily unlock and remove a seat using only one hand.

According to one aspect of the invention, a seat lock device is provided with which one can lift a seat by placing one hand on a portion (e.g., a rear portion) of a seat and then rotatably operating a lever member with one's fingertips so as to release a lock and then lifting the seat with that same hand while holding the lever member in the unlocked condition.

According to one aspect of the invention, there is provided a seat lock device for mounting a seat to a seat mounting bed of a vehicle. The seat lock device includes an engaging member connected to one of a seat and a seat mounting bed. The seat lock device also includes a locking mechanism connected to an other one of the seat and the seat mounting bed. The locking mechanism is movable between a locked position and an unlocked position, and the locking mechanism engages the engaging member when in the locked position to lock the seat to the seat mounting bed, while the locking mechanism disengages from the engaging member when in the unlocked position to unlock the seat from the seat mounting bed. The locking mechanism includes a lever member pivotally mounted to the other one of the seat and the seat mounting bed. Rotation of the lever member moves the locking mechanism between the locked position and the unlocked position.

According to another aspect of the invention, there is provided a seat lock device for mounting a seat to a seat mounting bed of a vehicle. The seat lock device includes an engaging member connected to one of a seat and a seat mounting bed. The seat lock device also includes a locking member movably connected to an other one of the seat and the seat mounting bed so as to be movable relative to the other one of the seat and the seat mounting bed, such that a locking portion of the locking member is alternately movable into and out of engagement with the engaging member to alternately lock and unlock the engaging member and the locking member. The seat lock device also includes a lever member pivotally mounted to the other one of the seat and the seat mounting bed, and engaged with the locking member. Upon rotating the lever member, the locking member moves relative to the other one of the seat and the seat mounting bed to selectively lock and unlock the engaging member and the locking member.

The seat lock device can also include a support block connected to the other one of the seat and the seat mounting bed, the support block including a receiving groove that removably receives a locking portion of the engaging member. The locking member is reciprocally slidable within the support block so that the locking portion of the locking member alternately moves into and out of the receiving groove to alternately lock and unlock with the locking portion of the engaging member.

The locking portion of the engaging member can include an opening, with the locking portion of the locking member being movable into and out of the opening.

The lever member can be L-shaped and include a leg portion and a foot portion. The foot portion is movably connected to the locking member, and a finger engageable operating portion is formed at an end of the lever member leg portion.

The seat can be a straddle seat that is straddled by a user. The vehicle can be a water craft.

According to another aspect of the invention, there is provided a seat lock device of a vehicle for attaching a bottom plate of a seat to a seat mounting bed. The seat lock device includes an engaging rod, a support block, a locking rod and a lever member.

The engaging rod has, e.g., a U-shaped configuration including a bridge portion and a pair of leg portions. The engaging rod is mounted on either the bottom plate of the seat or on the seat mounting bed, and preferably is mounted in a transverse direction of the seat.

The support block is provided with a receiving groove (e.g., at a front portion thereof) for receiving the bridge portion of the engaging rod. The support block is mounted on either the bottom plate of the seat or the seat mounting bed opposite from the engaging rod.

The locking rod has, e.g., a U-shaped configuration including a bridge portion and a pair of leg portions. The locking rod is disposed in the support block, and preferably is biased by a spring such that it is movable in a longitudinal direction in a horizontal plane. Both ends of the leg portions of the locking rod are movable into and out of the receiving groove for engaging with the bridge portion of the engaging rod.

The lever member is pivotally mounted relative to the support block. For example, the lever member can be pivotally mounted to a pair of brackets that are mounted on the left and right sides of a rear portion of the support block. The lever member is engaged with the bridge portion of the locking rod. Upon rotating the lever member, the locking rod is retracted against the biasing force of the spring so as to release the seat from the locked state to enable lifting of the bottom plate of the seat.

It is preferable that the engaging rod and the locking rod be formed by bending a rod in a U-shape, respectively. The engaging rod is provided with leg portions that extend in parallel at both ends of the bridge portion. Each leg portion is disposed on either the seat or the seat mounting bed, and extended in a normal direction thereto. The locking rod is provided with leg portions at both sides of the bridge portion, and the locking rod is disposed in the support block to extend in a lateral direction. Both ends of the leg portions of the locking rod, that is, the extremities of it are movable into and out of the receiving groove in a direction that is perpendicular to the direction in which the receiving groove extends. When extended into the receiving groove, the extremities of the locking rod leg portions engage with the bridge portion of the engaging rod.

Accordingly, in a condition in which the seat is locked, the bridge portion of the engaging rod is located adjacent to a bottom of the receiving groove and is locked therein by both ends of the locking rod leg portions. Since the locking rod leg portions are spaced apart in the transverse direction of the seat, any play which may be caused by lateral swaying of the rear portion of the seat is eliminated.

When the engaging rod is mounted on the seat mounting bed, the engaging rod extends upwardly and the support block having the locking rod is mounted on the bottom plate of the seat so as to correspond to the engaging rod. Removal of the seat can be readily carried out such that an individual places one hand on a portion (e.g., the rear portion) of the seat, unlocks the seat lock by rotating the lever member with one or more fingers so as to retract the locking rod against the biasing force of the spring using the action of the lever member and then removes the seat by lifting the seat using the same hand.

There is no structural limit for the manner in which the lever member engages with the bridge portion of the locking rod. However, it is preferable that the lever member has an L-shaped configuration including a leg portion and a foot portion as seen from one side thereof, and the lever member is provided with a recessed groove at the end of the foot portion for receiving the bridge portion of the engaging rod. Additionally, it is preferable that the bridge portion of the locking rod fits into and is engaged with the recessed groove of the foot portion, and a finger engageable operating portion is formed at the end of the lever member leg portion. The locking rod can be retracted by rotating the lever member about a support shaft that is provided between the recessed groove and the finger engageable operating portion. As the lever member rotates, the bridge portion of the locking rod slides along the inner surface of the recessed groove. Since the end of the foot portion of the lever member is directly engaged with the bridge portion of the locking rod, no additional parts for engagement are necessary. The lever member can be produced by an integral plastic molding for the sake of structural simplicity.

The engaging rod can be mounted on either the bottom plate of the seat or the seat mounting bed, and the support block can be mounted on the other one of those two elements. The selection usually depends on the design of the seat of the vehicle.

BRIEF DESCRIPTION OF THE DRAWINGS

These objects as well as other objects, features and advantages of the present invention will become more apparent to those skilled in the art from the following description with reference to the accompanying drawings in which like reference numerals designate like elements and wherein.

DETAILED DESCRIPTION OF PREFERRED EMBODIMENTS

Figure 1:
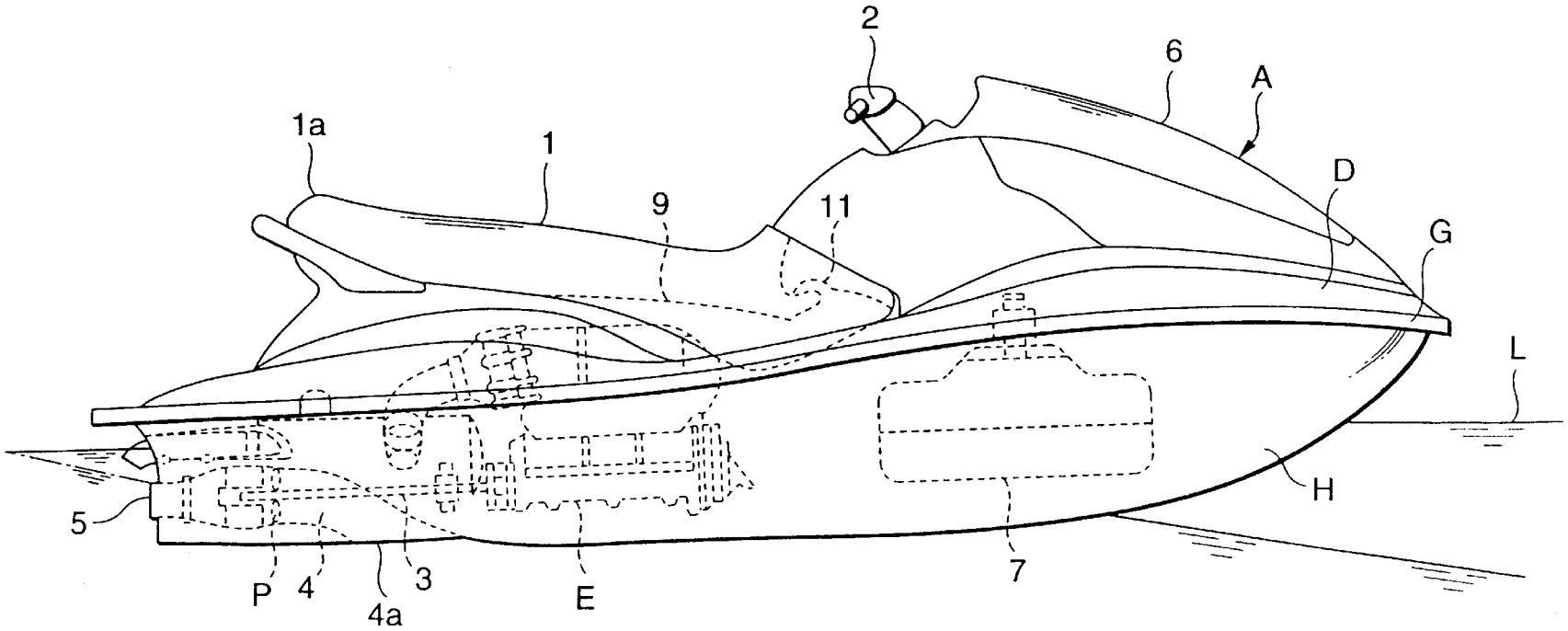
FIG. 1 is an overall side view of a personal water craft to which an embodiment of this invention is applied.

FIG. 1 is an overall side view of a personal water craft to which one embodiment of this invention is applied. As shown in FIG. 1, the personal water craft A includes a hull H, which constitutes a lower portion of a body, and a deck D, which covers the upper portion of the hull H. The hull H and the deck D are both made of plastic, for example. The hull H and the deck D are connected to each other around their entire peripheries to constitute a hollow shell structure. As illustrated in the drawing, a connecting line G between the hull H and the deck D, or a so-called gunwale line, is positioned above a draft line L.

A handle 2 for steering is provided at the central upper portion of the deck D. A straddle type seat 1, which extends in a longitudinal direction of the body A, is disposed behind the handle 2. An engine E is mounted in a space that is disposed below the seat 1 and defined by the hull H and the deck D.

A pump installation space is defined at the rear portion of the hull H body, and a water jet pump P is installed therein. The water jet pump P is connected with the engine E through a propeller shaft 3. Upon driving of the engine E, water is sucked in from a water suction opening 4*a* located at the bottom of the hull. Water is then introduced into the pump P through a duct 4 disposed in a rearwardly and upwardly inclined manner. The water is pressurized and accelerated by the pump P, and is ejected rearward from a jet nozzle disposed behind the pump P so as to generate a propulsion power of the water craft. A steering nozzle 5 is capable of pivoting in the horizontal plane and is arranged behind the jet nozzle. The steering nozzle 5 is connected with the handle 2 by a steering cable (not shown in the drawings). Upon operation of the handle 2, the steering nozzle 5 is pivoted in the leftward or rightward direction for steering in the desired direction. In the drawing, numeral 6 indicates a hatch cover mounted on the front portion of the water craft A, and numeral 7 indicates a fuel tank.

Figure 2:
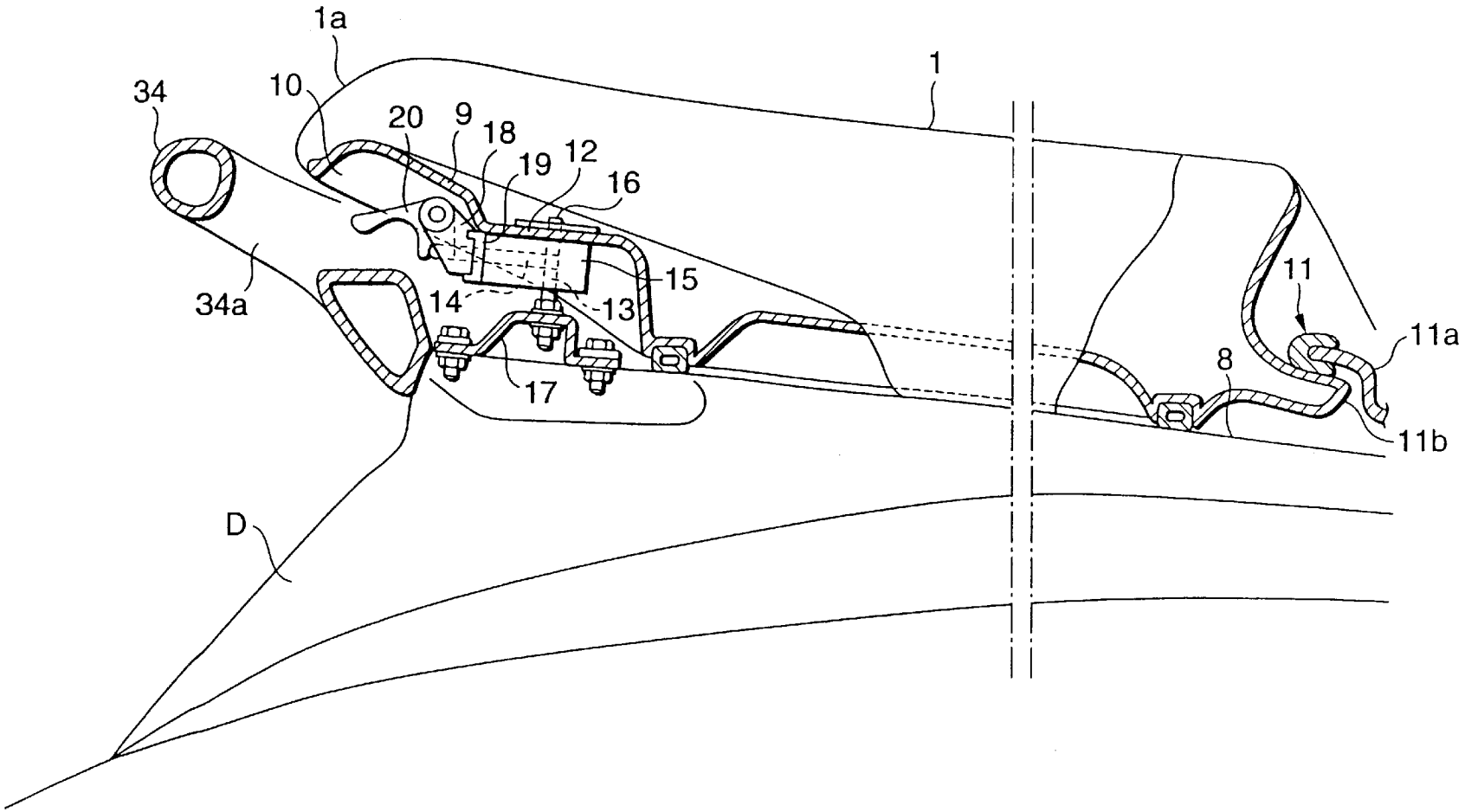
FIG. 2 is a side view of FIG. 1, with a rear portion of a seat enlarged and a part thereof shown in cross section.
Figure 3:
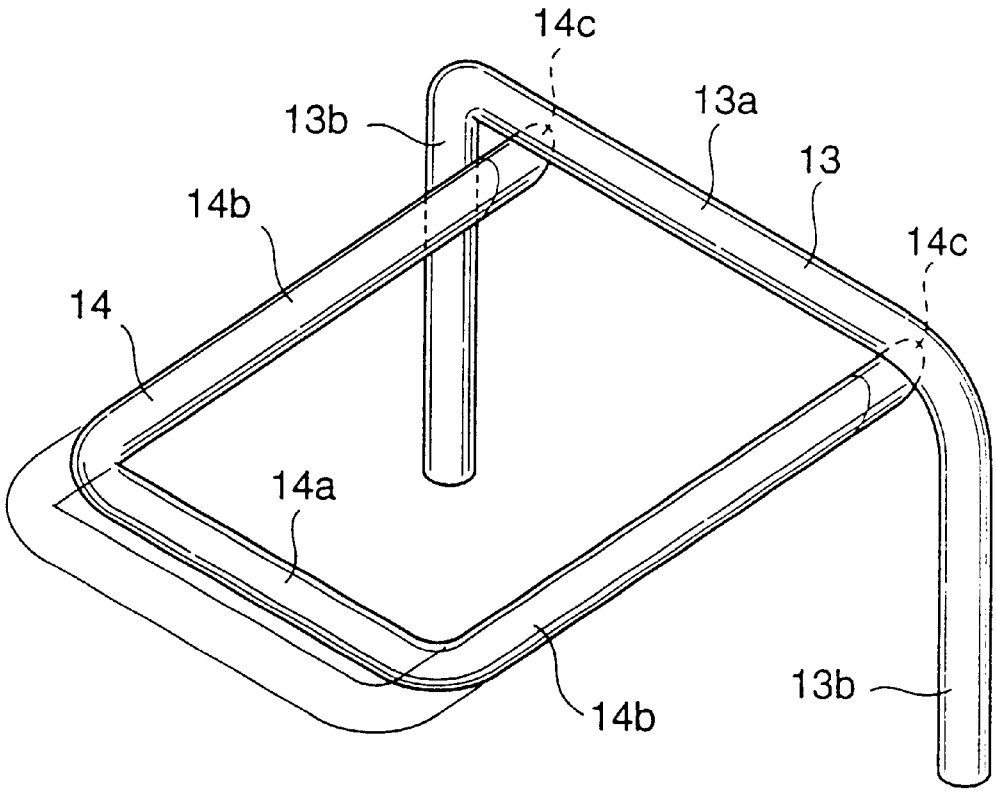
FIG. 3 is a view showing the positional relationship between an engaging rod and a locking rod.

FIG. 2 is a side view that shows the rear portion of the seat 1 shown in FIG. 1 in an enlarged form and partially in cross-section. FIG. 3 shows the positional relationship between an engaging rod 13 and a locking rod 14, which will be explained below. As shown in FIG. 2, the seat 1 is mounted on a seat mounting bed 8 disposed on the deck D.

The front portion of the seat 1 is mounted on the seat mounting bed 8 by an engaging structure 11. The engaging structure 11 includes an engaging portion 11*a* and a protruding portion 11*b*. The engaging portion 11 a is secured to the surface of the deck D or the hull H or the like. The protruding portion 11*b* extends in a forward direction from a bottom plate 9 of the seat, and is provided in the front portion of the seat. The engaging portion 11*a* and the protruding portion 11*b* are connected detachably by pushing protruding portion 11*b* into (and underneath) the engaging portion 11*a* from behind.

The rear portion 1*a* of the seat 1 is disposed away from the seat mounting bed 8. A space 10 is defined between the bottom plate 9 of the seat 1 and the seat mounting bed 8. When the seat 1 is positioned at a normal mounting position, a seat locking device 12 for locking the seat 1 is disposed in the space 10 between the rear portion of the bottom plate 9 of the seat 1 and the seat mounting bed 8.

As shown in FIG. 3, the seat locking device 12 includes an inverted U-shaped engaging rod 13 and a U-shaped locking rod 14. The engaging rod 13 is provided with a pair of leg portions 13*b* disposed in parallel at respective ends of a bridge portion 13*a*. The engaging rod 13 is formed by bending a rod, for example. The locking rod 14 is also provided with a pair of leg portions 14*b* disposed in parallel at respective ends of a bridge portion 14*a*. The leg portions 14*b* are also formed by bending a rod, for example. The engaging rod 13 is disposed longitudinally while the locking rod 14 is disposed laterally. Thus, the engaging rod 13 is arranged (i.e., extends in a plane) orthogonal to (the plane of) the locking rod 14. Both ends 14*c* of the locking rod 14 are engaged with the bridge portion 13*a* of the engaging rod 13. As can be seen in FIG. 2, the locking rod 14 is mounted on a support block 15 such that the locking rod 14 is movable in a longitudinal direction of the seat 1 in a substantially horizontal plane. In this embodiment, the support block 15 is mounted on the bottom plate 9 of the seat 1 by a fixing structure 16 such as bolts and nuts. The bridge portion 13*a* of the engaging rod 13 is arranged in the transverse direction of the seat 1 (i.e., it extends across the seat from left to right sides of the water craft). The leg portions 13*b* of the engaging rod 13 are mounted on the seat mounting bed 8 with a support plate 17.

A support member 19 having a pair of left and right brackets 18 is mounted on the rear portion of the support block 15. A lever member 20 is pivotally mounted between both brackets 18, and the lever member 20 is engaged with the bridge portion 14*a* of the locking rod 14 (see FIGS. 4, 5 and 6). The support block 15 and its related members are explained further with reference to FIGS. 4 to 6.

Figure 4:
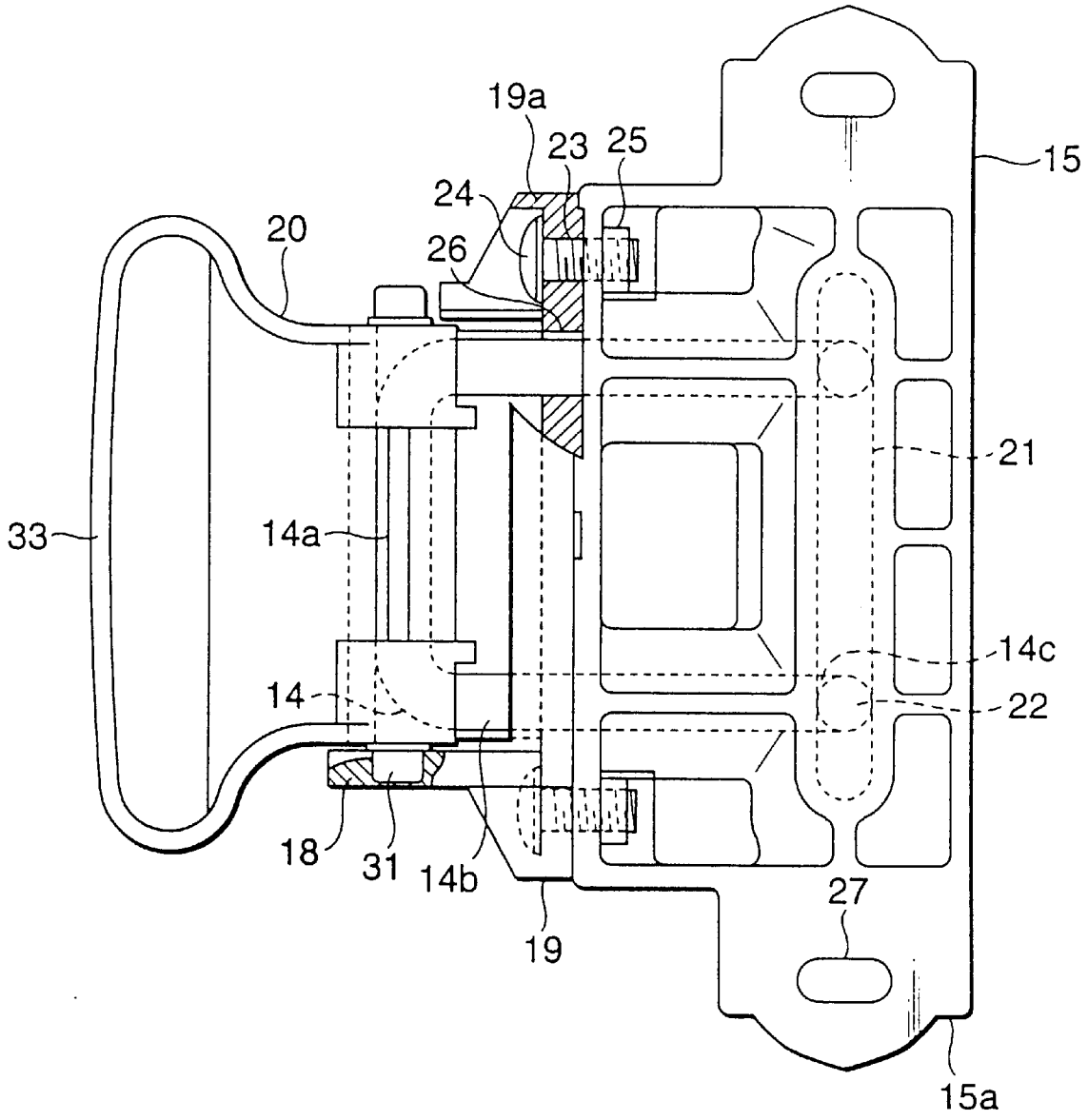
FIG. 4 is a plan view of a support block and related members.
Figure 5:
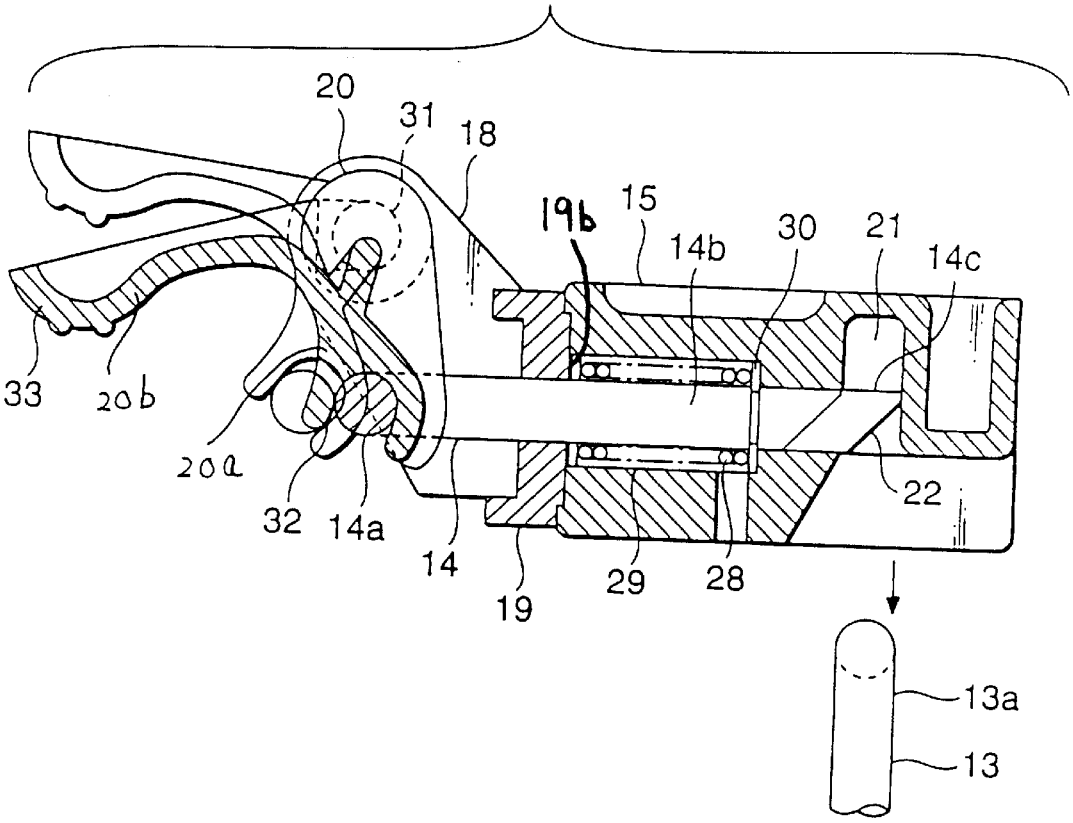
FIG. 5 is a longitudinal cross-sectional view of the support block and the related members.
Figure 6:
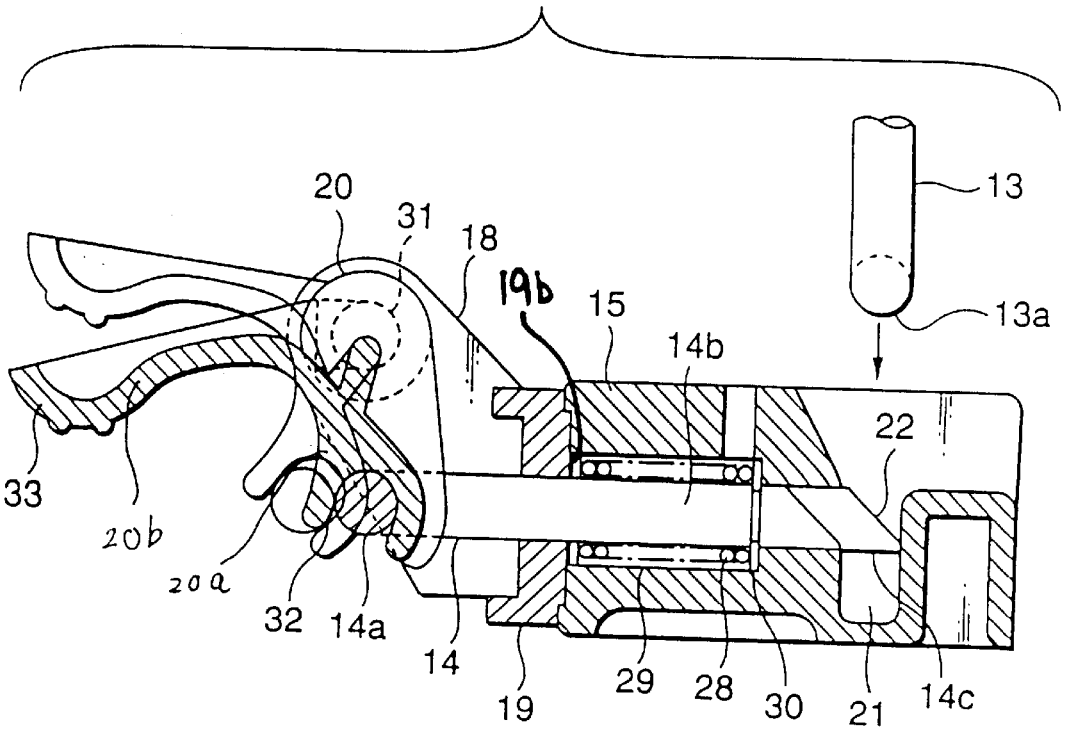
FIG. 6 is a longitudinal cross-sectional view of the support block and related members of a modified embodiment.
Figure 7:
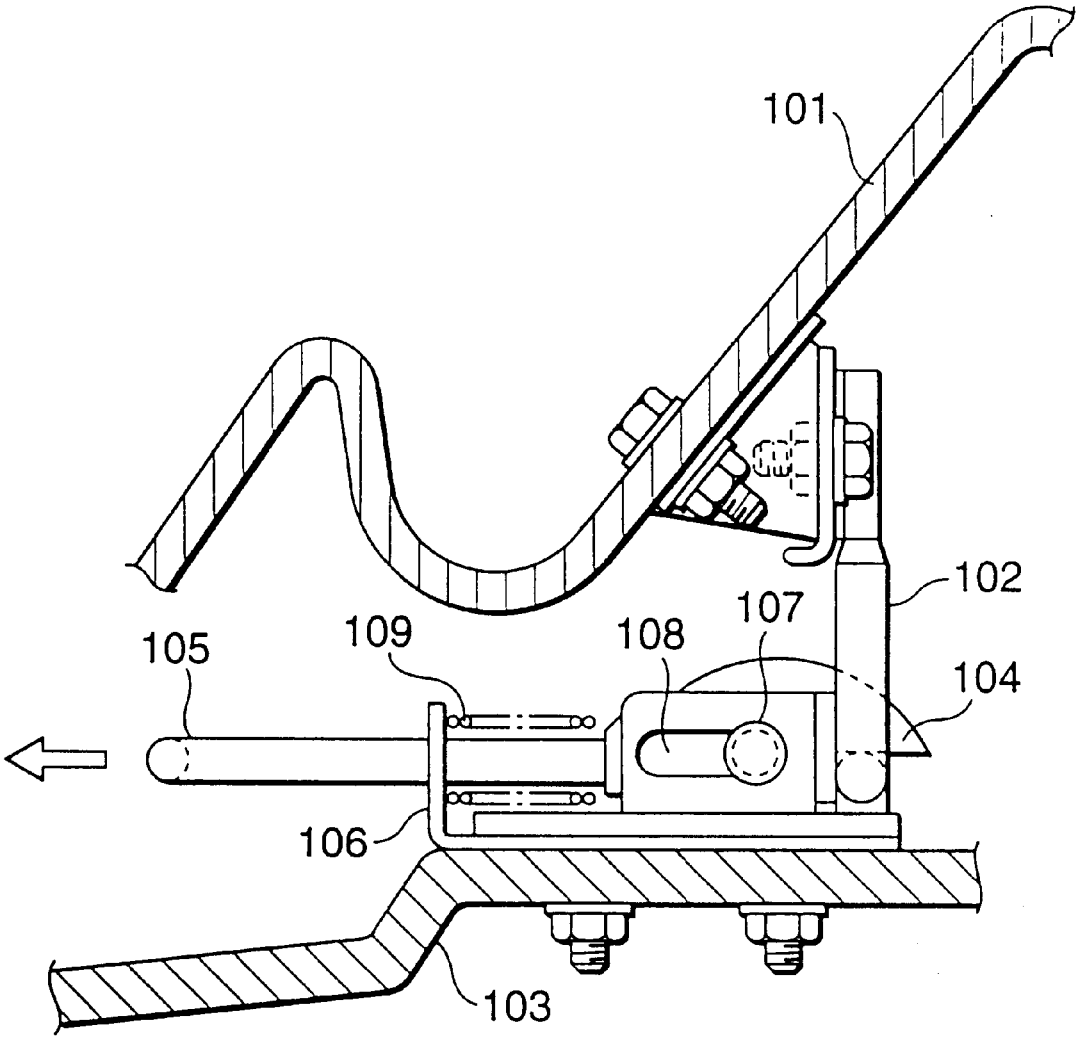
FIG.7 PRIOR ART
FIG. 7 is a longitudinal cross-sectional view showing an example of a conventional seat locking device.

FIG. 4 is a plan view of the support block 15 and its related members. FIG. 5 is a longitudinal cross sectional view of the support block 15 and its related members of one embodiment. FIG. 6 is a longitudinal cross sectional view of the support block 15 and its related members in a modified embodiment.

A receiving groove 21 is formed in the front portion of the support block 15 to receive the bridge portion 13*a* of the engaging rod 13. The leg portions 14*b* of the locking rod 14 are inserted into the support block from the rear such that the ends 14*c* of both leg portions 14*b* of the locking rod 14 are moveable into and out of the receiving groove 21. The bridge portion 14*a* of the locking rod 14 protrudes from the back of the support block 15. Inclined guide surfaces 22 are formed on both ends 14*c* of the locking rod 14 for guiding the bridge portion 13*a* of the engaging rod 13 to enter into the receiving groove 21.

The support member 19 is formed to fit to the back of the support block 15 with mounting portions 19*a* at the left and right ends thereof. The mounting portions 19*a* are provided with mounting holes 23 respectively. The support member 19 is attached to the back of the support block 15 by bolts 24 and nuts 25, which are located laterally outside of the locking rod 14, and that pass through the mounting holes 23 from the outside of the mounting portions 19*a*. Since the support member 19 is located between the back of the support block 15 and the bridge portion 14*a* of the locking rod 14, which extends rearwardly relative to the support block 15, though holes 26 are formed in the support member 19 for passing the leg portions 14*b* of the locking rod 14. The leg portions 14*b* are inserted into the through holes 26 at the time of assembling the locking rod 14 to the support block 15. In the drawings, numeral 15*a* indicates mounting lugs provided in the left and right sides of the support block 15. These lugs 15*a* have mounting holes 27. These mounting holes 27 are holes for fixing structure 16 (see FIG. 2) that fixes the support block 15 to the bottom plate 9 of the seat 1. For example, the mounting holes 27 are used for passing bolts.

As shown in FIG. 5 and FIG. 6, springs 28 are disposed between the leg portions 14*b* of the locking rod 14 and the support block 15. In the embodiments, the springs 28 are accommodated in spring accommodating chambers 29 formed in the support block 15. Each leg portion 14*b* is inserted into a coil of the springs 28. The springs 28 have a rear end portion thereof forcibly brought into contact with a wall surface 19*b* of the spring accommodating chamber 29 and have a front end portion thereof forcibly brought into contact with an annular receiving plate 30 which is fixedly secured to the leg portions 14*b*. For example, as shown, annular receiving plate 30 can snap into a groove formed in the outer surface of leg portion 14*b*. Both ends 14*c* of the locking rod 14 are biased in the direction to extend into the receiving groove 21, i.e., in the forward direction.

The lever member 20 has an approximately L shape as seen from a side thereof. Bearing shafts 31 are provided on both sides of the lever member 20, and are pivotally mounted to the bracket 18 (see FIG. 4). The bearing shafts 31 are disposed above the bridge portion 14*a* of the locking rod 14, and are located at an intermediate portion of the lever member 20. The bridge portion 14*a* of the locking rod 14 is fitted into a recess 32 formed in the end of a foot portion 20*a* of the lever member 20. Thus, the locking rod 14 and the lever member 20 are slideably engaged with each other. A leg portion 20*b* of the lever member 20 extends rearwardly. A finger engageable operating portion 33, with which one or more fingers can be engaged from below, is formed at an end of the leg portion 20*b*.

The support member 19 is formed such that it can be mounted to the support block 15 even when the support block 15 is inverted (compare FIGS. 5 and 6). In the embodiment shown in FIG. 5, the engaging rod 13 is mounted on the seat mounting bed 8 such that the engaging rod 13 extends upwardly as can be seen in FIG. 2. The support block 15 having the locking rod 14 is mounted on the bottom plate 9 of the seat 1 such that the receiving groove 21 of the support block 15 is directed downwardly. In this case, the finger engageable operating portion 33 of the lever member 20 is disposed at a position higher than the bridge portion 14*a* of the locking rod 14 protruding rearwardly from the support block 15. The fingertips can be engaged with the finger engageable operating portion 33 from below. The locking of the seat 1 is released by pulling the finger engageable operating portion 33 in an upward direction. That is, as shown by a thin line in FIG. 5, when the finger engageable operating portion 33 is pulled upwardly, the lever member 20 is rotated and the locking rod 14 is retracted against the biasing force of the spring 28, and both end portions 14*c* of the locking rod 14 are retracted from the receiving groove 21. Hence the engaging relationship between the locking rod 14 and the bridge portion 13*a* of the engaging rod 13 is released or cancelled.

Accordingly, when the rear portion 1*a* of the seat 1 is lifted and then pulled rearwardly after the above-mentioned lock releasing operation, the seat 1 can be removed. Furthermore, to return the lifted seat 1 to the original mounting position, while holding the rear portion 1*a* of the seat 1 in the lifted condition, the following steps are carried out in reverse order of the above mentioned steps. That is, the protruding portion 11*b*, which extends in a frontward direction from the bottom plate 9 of the seat 1, is engaged with the fixed-side engaging portion 11*a*. The rear portion 1*a* is lowered so that the bridge portion 13*a* of the engaging rod 13, which constitutes the locking mechanism 12, enters the inside of the receiving groove 21 of the support block 15. When the bridge portion 13*a* enters the receiving groove 21, the bridge portion 13*a* pushes the guide surface 22 of both end portions 14*c* of the locking rod 14, which protrude inside the receiving groove 21 and makes the locking rod 14 retract against the biasing force of the spring 28, thus allowing the bridge portion 13*a* to be seated in the receiving groove 21. Thereafter, the locking rod 14 is again advanced or moved forward by the biasing force of the spring 28 and both end portions 14*c* are protruded into the receiving groove 21 to be engaged with the bridge portion 13*a* to complete the locking operation. In this manner, no particular lock actuation operation is necessary for locking the seat 1. In this embodiment, locking of the seat 1 is released by rotatably operating the lever member 20 and hence, even when a rear grip 34 (see FIG. 2) is mounted on the deck D behind the seat 1 and adjacent to the rear portion 1*a* of the seat 1, a hand can be inserted into a narrow gap defined between the rear grip 34 and the seat 1, and the lever member 20 can be operated. Furthermore, a hand may be inserted into an intermediate hole 34*a* from the lower side of the rear grip 34 so as to operate the lever member 20. This invention is also applicable to a seat divided into front and rear seat portions.

According to this embodiment, a release of locking for removing the seat is performed by rotatably operating the lever member using the fingertips of one hand placed on the rear portion of the seat. Since seat lifting operations can be performed by one hand, the operability is enhanced.

FIG. 6 shows a modification of the embodiment shown in FIG. 5. In the embodiment of FIG. 6, the engaging rod 13 is mounted on the seat, and the support block 15 is mounted on the seat mounting bed. Thus, the support block 15 is mounted in an inverted manner compared to the embodiment shown in FIG. 5. Accordingly, this invention is applicable to various kinds of a seat of a vehicle and is versatile.

The invention is not limited to the preferred embodiments described above. It is possible to use structures other than the specific structures illustrated in the drawings to practice aspects of the invention.

According to one aspect of the invention, a seat lock device is provided with which one can lift a seat by placing one hand on a portion (e.g., a rear portion) of a seat and then rotatably operating a lever member with one's fingertips so as to release a lock and then lifting the seat with that same hand while holding the lever member in the unlocked condition.

According to one aspect of the invention, the seat lock device includes an engaging member connected to one of a seat and a seat mounting bed. The seat lock device also includes a locking mechanism connected to an other one of the seat and the seat mounting bed. The locking mechanism is movable between a locked position and an unlocked position, and the locking mechanism engages the engaging member when in the locked position to lock the seat to the seat mounting bed, while the locking mechanism disengages from the engaging member when in the unlocked position to unlock the seat from the seat mounting bed. The locking mechanism includes a lever member pivotally mounted to the other one of the seat and the seat mounting bed. Rotation of the lever member moves the locking mechanism between the locked position and the unlocked position.

According to another aspect of the invention, the seat lock device includes an engaging member connected to one of a seat and a seat mounting bed. The seat lock device also includes a locking member movably connected to an other one of the seat and the seat mounting bed so as to be movable relative to the other one of the seat and the seat mounting bed, such that a locking portion of the locking member is alternately movable into and out of engagement with the engaging member to alternately lock and unlock the engaging member and the locking member. The seat lock device also includes a lever member pivotally mounted to the other one of the seat and the seat mounting bed, and engaged with the locking member. Upon rotating the lever member, the locking member moves relative to the other one of the seat and the seat mounting bed to selectively lock and unlock the engaging member and the locking member.

The seat lock device can also include a support block connected to the other one of the seat and the seat mounting bed, the support block including a receiving groove that removably receives a locking portion of the engaging member. The locking member is reciprocally slidable within the support block so that the locking portion of the locking member alternately moves into and out of the receiving groove to alternately lock and unlock with the locking portion of the engaging member.

The locking portion of the engaging member can include an opening, with the locking portion of the locking member being movable into and out of the opening.

The lever member can be L-shaped and include a leg portion and a foot portion. The foot portion is movably connected to the locking member, and a finger engageable operating portion is formed at an end of the lever member leg portion.

The seat can be a straddle seat that is straddled by a user. The vehicle can be a water craft.

While the present invention has been described with reference to preferred embodiments thereof, it is to be understood that the invention is not limited to the disclosed embodiments or constructions. To the contrary, the invention is intended to cover various modifications and equivalent arrangements. In addition, while the various elements of the disclosed invention are shown in various combinations and configurations, that are exemplary, other combinations and configurations, including more, less or only a single element, are also within the spirit and scope of the invention.

What is claimed is:

1. A seat lock device for mounting a straddle seat that is straddled by a user to a seat mounting bed of a vehicle, the seat lock device comprising:

a U-shaped engaging rod having a bridge portion and a pair of leg portions, the engaging rod connected to one of a seat and a seat mounting bed;

a locking member movably connected to an other one of the seat and the seat mounting bed so as to be movable relative to the other one of the seat and the seat mounting bed, such that a locking portion of the locking member is alternately movable into and out of engagement with the bridge portion of the engaging rod to alternately lock and unlock the engaging rod and the locking member, the locking member being movable linearly in a plane; and a lever member pivotally mounted to the other one of the seat and the seat mounting bed, the lever member being slidably attached to the locking member, wherein rotation of the lever member about a pivot point moves the locking member linearly between the locked position and the unlocked position.

2. A vehicle including the lock device of claim 1.

3. The vehicle of claim 2, wherein the vehicle is a water craft.

4. The seat lock device of claim 1, wherein the seat and the seat mounting bed each have a front end and a rear end, the engaging rod, the locking member and the lever member located adjacent to the rear ends of the seat and of the seat mounting bed.

5. A seat lock device for mounting a seat to a seat mounting bed of a vehicle, the seat lock device comprising:

an engaging member connected to one of a seat and a seat mounting bed;

a locking member movably connected to an other one of the seat and the seat mounting bed so as to be movable relative to the other one of the seat and the seat mounting bed, such that a locking portion of the locking member is alternately movable into and out of engagement with the engaging member to alternately lock and unlock the engaging member and the locking member;

a support block connected to the other one of the seat and the seat mounting bed, the support block including a receiving groove that removably receives a locking portion of the engaging member, the locking member being reciprocally slidable within the support block so that the locking portion of the locking member alternately moves into and out of the receiving groove to alternately lock and unlock with the locking portion of the engaging member; and a lever member pivotally mounted to the other one of the seat and the seat mounting bed, and engaged with the locking member, wherein upon rotating the lever member, the locking member moves relative to the other one of the seat and the seat mounting bed to selectively lock and unlock the engaging member and the locking member.

6. The seat lock device of claim 5, wherein the locking portion of the engaging member includes an opening, and the locking portion of the locking member is movable into and out of the opening.

7. The seat lock device of claim 5, wherein the lever member is L-shaped and includes a leg portion and a foot portion, the foot portion being movably connected to the locking member, and a finger engageable operating portion is formed at an end of the lever member leg portion.

8. The seat lock device of claim 5, wherein the seat is a straddle seat that is straddled by a user.

9. A vehicle including the lock device of claim 8.

10. The vehicle of claim 9, wherein the vehicle is a water craft.

11. The seat lock device of claim 5, wherein the seat and the seat mounting bed each have a front end and a rear end, the engaging member, the locking member, the support block and the lever member located adjacent to the rear ends of the seat and of the seat mounting bed.

12. A seat lock device for mounting a seat to a seat mounting bed of a vehicle, said seat lock device comprising:

a U-shaped engaging rod having a bridge portion and a pair of leg portions, the engaging rod connected to one of a seat and a seat mounting bed;

a support block having a receiving groove that removably receives the bridge portion of the engaging rod, the support block connected to an other one of the seat and the seat mounting bed;

a U-shaped locking rod having a bridge portion and a pair of leg portions and being movably disposed in the support block such that ends of the locking rod leg portions are alternately movable into and out of the receiving groove to selectively engage with the engaging rod bridge portion to lock the engaging rod in the receiving groove; and a lever member pivotally mounted with respect to the support block, and engaged with the locking rod bridge portion, wherein upon rotating the lever member, the locking rod moves relative to the support block so that the ends of the locking rod leg portions release the engaging rod bridge portion from being locked in the receiving groove.

13. The seat lock device of claim 12, wherein the lever member is L-shaped and includes a leg portion and a foot portion, the foot portion has a recessed groove that receives the locking rod bridge portion, and a finger engageable operating portion is formed at an end of the lever member leg portion.

14. The seat lock device of claim 13, wherein the lever member is pivotally mounted at a position spaced from a plane in which the locking rod extends.

15. The seat lock device of claim 12, further comprising a supporting member having a pair of brackets, the supporting member secured to the support block, and the lever member is pivotally mounted to the pair of brackets.

16. The seat lock device of claim 12, wherein the lever member is pivotally mounted at a position spaced from a plane in which the locking rod extends.

17. The seat lock device of claim 12, wherein the engaging rod bridge portion extends in a direction transverse to the seat.

18. The seat lock device of claim 12, wherein the support block includes a biasing member that biases the locking rod so that the ends of the locking rod leg portions extend into the receiving groove.

19. The seat lock device of claim 12, wherein the seat is a straddle seat that is straddled by a user.

20. A vehicle including the lock device of claim 19.

21. The vehicle of claim 20, wherein the vehicle is a water craft.

* * * * *